US007018120B2

(12) United States Patent
Takagi

(10) Patent No.: US 7,018,120 B2
(45) Date of Patent: Mar. 28, 2006

(54) PRINTING METHOD OF PRINTER APPARATUS

(75) Inventor: Tatsuya Takagi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 71 days.

(21) Appl. No.: 10/637,647

(22) Filed: Aug. 11, 2003

(65) Prior Publication Data

US 2004/0114945 A1 Jun. 17, 2004

(30) Foreign Application Priority Data

Aug. 16, 2002 (JP) ..... 2002-237505

(51) Int. Cl.

| | |
|---|---|
| ***G03G 15/00*** | (2006.01) |
| ***B41J 3/60*** | (2006.01) |
| ***B65H 85/00*** | (2006.01) |
| ***B65H 29/58*** | (2006.01) |
| ***B65H 29/60*** | (2006.01) |

(52) U.S. Cl. ..... 400/582; 399/20; 399/21; 399/364; 399/401

(58) Field of Classification Search ..... 399/20, 399/21, 401, 364; 271/9.01–9.13; 400/624, 400/625, 629, 582

See application file for complete search history.

(56) References Cited

U.S. PATENT DOCUMENTS 5,393,043 A * 2/1995 Nitta ..... 271/9.06
5,678,138 A * 10/1997 Kobayashi et al. ..... 399/18
5,933,677 A * 8/1999 Lee ..... 399/20
6,085,049 A * 7/2000 Tanigawa ..... 399/20
2003/0190179 A1* 10/2003 Kinoshita et al. ..... 399/401

FOREIGN PATENT DOCUMENTS

| | | | |
|---|---|---|---|
| DE | 40 38 271 | | 6/1991 |
| JP | 01193759 | A * | 8/1989 |
| JP | 11246078 | A * | 9/1999 |
| JP | 2000112193 | A * | 4/2000 |
| WO | 0 397 199 | | 11/1990 |

OTHER PUBLICATIONS

Machine translatin of JP 2000-112193 to Takanashi from Japanese Patent Office website.*
Machine translation of JP 11-246078 to Doi from Japanese Patent Office website.*

* cited by examiner

*Primary Examiner*—Daniel J. Colilla
(74) *Attorney, Agent, or Firm*—Rabin & Berdo, P.C.

(57) ABSTRACT

At the detection of an occurrence of a sheet feeder jam, in a case where media in the course of being printed on one face exist, printing this one face is continued, and this medium is inserted into the duplex printing unit. After this, relief of the sheet feeder jam is requested, and change in the duplex printing unit is monitored. In the case where there is no change in the duplex printing unit, after the printing process is re-started, re-use of the medium is allowed.

5 Claims, 9 Drawing Sheets

B①DETECTING PROCESS OF JAM (S(2)1)

B②WATCHING PROCESS OF MEDIA (S(2)2)

B③STARTING PROCESS OF FEEDING MEDIA (S(2)3)

B④WATCHING PROCESS OF FEEDING MEDIA (S(2)4)

B⑤DEMANDING PROCESS OF RELIEVING JAM (S(2)5)

PRINTING METHOD OF PRINTER APPARATUS

BACKGROUND OF THE INVENTION

1. Field of the Invention

The present invention relates to a printing method of printer apparatus.

2. Description of the Related Art

In conventional printer apparatus, in the case where a sheet feeder jam has occurred, either of the following two methods has been adopted.

(1) The printer apparatus was stopped at once, and the occurrence of a sheet feeder jam was presented at an operator's panel etc. Then, the operator was asked to relieve the jam. After the operator had relieved the sheet feeder jam, the printing process was re-started. In this case, the medium in the course of printing was abandoned.

(2) Although, in principle, it is the same as (1); in the case where there was a sheet already printed on one of its faces at the moment of occurrence of the sheet feeder jam, the printing process was continued on the other face. After this medium was issued, the printing process was stopped, and the occurrence of the sheet feeder jam was presented at an operator's panel etc, so as to request relief of the jam. After the operator relieved the jam, the printing process was re-started. Here, the sheet feeder jam means a state where a sheet feeding sensor does not become turned ON, despite passing of a certain time interval from the start of a sheet feeding operation.

However, the following problem remained unsolved in the conventional art mentioned above. That is, at the moment of occurrence of a sheet feeder jam, the case where a sheet exists waiting in the duplex printing unit printed completely on one of its faces. In this case, the printing process was stopped as well. Then, the operator had to exclude the sheet waiting in the duplex printing unit as well as the operator having to relieve the sheet feeder jam. Otherwise, the printing process could not be re-started.

As a result, when the printing process was re-started, it had to be done about the part which is the same as the part already completed printing on one face. Further, when a sheet feeder jam occurred, even if the printer was in the state that sheet feeding from another sheet feeder or duplex printing unit was possible: the printing process was stopped at once as well.

SUMMARY OF THE INVENTION

The present invention adopts the following configurations in order to solve the problems mentioned above.

<Configuration 1>

A printing method of printer apparatus having a mechanism for reversing media, so as to perform duplex printing; wherein, at the detection of occurrence of a sheet feeder jam, in the case where at least one medium in the course of one face printing exists, one face printing with this medium is continued, and this medium is conveyed in said mechanism for reversing media, after the one face printing is completed; then relief of sheet feeder jam is requested, and the printing process is re-started after the jam is relieved.

<Configuration 2>

A printing method of printer apparatus according to Configuration 1; wherein, at re-starting of the printing process, either the medium printed on one face or a new medium fed from the sheet feeder cassette of said printer apparatus, is selected.

<Configuration 3>

A printing method of printer apparatus having a duplex printing unit for reversing media, and requesting relief of the sheet feeder jam at the occurrence of the sheet feeder jam; wherein at the detection of occurrence of the sheet feeder jam, in the case where a medium printed on one face exist in the duplex printing unit, a printing process is performed on the other face of the medium, and after the printing process is completed, relief of the sheet feeder jam is requested.

<Configuration 4>

A printing method of printer apparatus requesting relief of the sheet feeder jam at the occurrence of the sheet feeder jam; wherein a conveying route for media in the printer apparatus is watched; a sheet feeder cassette able to be changed with the sheet feeder cassette causing the sheet feeder jam, is selected, and the printing process is continued with media fed from the changed sheet feeder cassette; after all the media fed from every available sheet feeder cassette is exhausted, a relief of the jam is requested.

<Operation>

In the case where printing media exist, after relief of a jam; even if they are printed on one of their faces, they can be re-used as far as normal process is performed on these printing media as well as it should be performed when the printer apparatus operates normally and the normal printing state is kept. Therefore, in the present invention, montoring of the duplex printing unit is continued. Not to mention the occasion when printing on one face is completed at the time of occurrence of sheet feed jam, even if the media are in the course of one face printing, it is continued. A relief of a jam is requested, after the media are inserted in the duplex printing unit, and a normal process performed when the printer apparatus is operating normally, is kept. The media kept in a normal printing state at re-starting of printing process, are re-used. Thus, a needless printing process at re-starting of printing can be avoided.

DETAILED DESCRIPTION OF THE PREFERRED EMBODIMENTS

Figure 1:
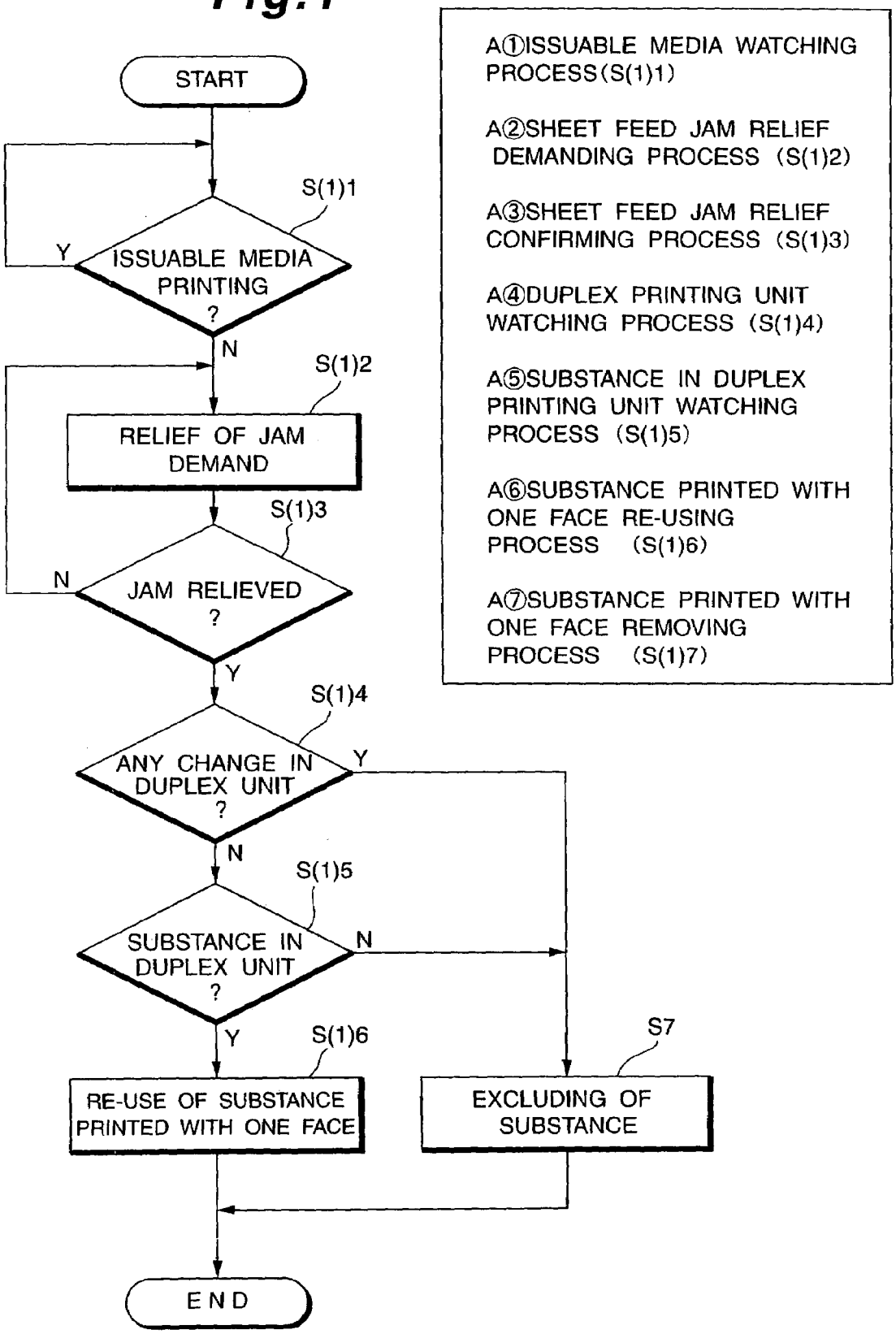
FIG. 1 is a flow-chart showing the process of the printing method of Embodiment 1.

Hereafter, the preferred Embodiments of the present invention will be described referring to the drawings.

Embodiment 1

Embodiment 1 relates to a printing method of enabling re-use of media for printing, that is, printing sheets either surface of which was completely printed, when jam in the printer occurred. Such printing media are entirely the same as printing media, which were printed in the case where a jam in the printer had not occurred between occurrence of the jam and relief of the jam. To achieve this re-use, the duplex printing unit in the printer is monitored continuously, in order to detect the occurrence of jams and the existence of printing media at that time.

FIG. 1 shows the processes of this method with a form of flow-chart as Embodiment 1.

In FIG. 1, the printing method for printer apparatus according to Embodiment 1 comprises an A process of watching existence of issuable media, an A process of requesting relief of a jam in a sheet feeder, an A process of confirming relief of jam in the sheet feeder, an A process of monitorng for abnormalities in a duplex printing unit, an A process of montoring media existing in the duplex printing unit, an A process of re-using double-faced media completely printed on one of their faces, and an A process of removing media from the apparatus.

Figure 2:
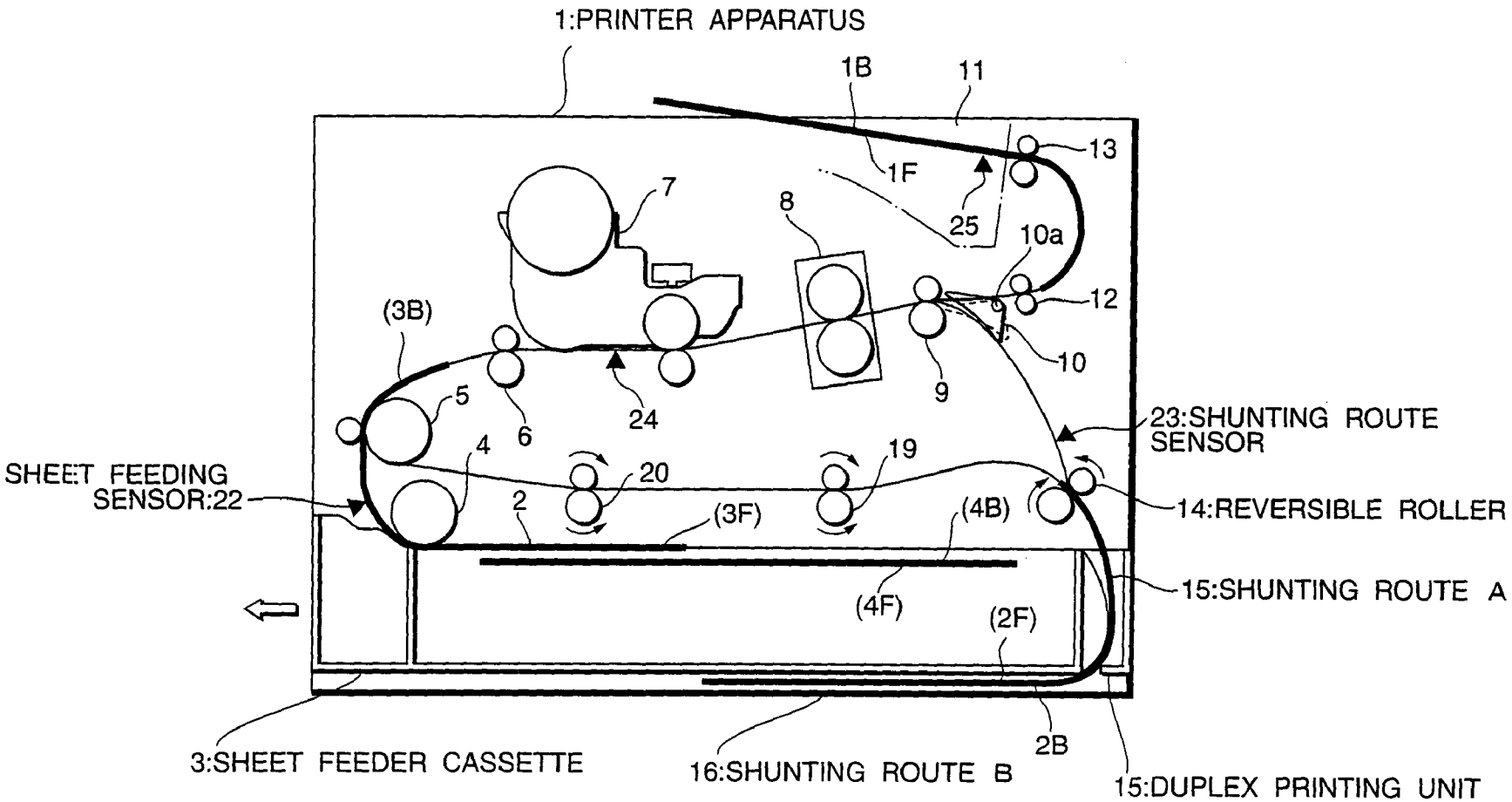
FIG. 2 is a sectional view showing the structure of a printing apparatus.

As an introduction to the description of these processes, an example of a printer apparatus, which the method of present invention applies to, is described referring to FIG. 2 about its structure and operation.

FIG. 2 shows a structure of a printer apparatus.

In FIG. 2, a sheet feeder cassette (tray) 3, which is detachable and contains paper (printing media) 2, is provided to a printer apparatus 1. This sheet feeder cassette 3 is able to move in the direction indicated by an arrow, and a sending roller 4, which is able to rotate to send out paper 2, is provided at an upper portion of a sending device, which faces the opening of the sheet feeder cassette 3. Further, a pair of conveying rollers 5, which are able to rotate to convey paper 2, are provided upward of the sending roller 4.

Moreover, a pair of conveying rollers 6 are provided at a position downstream of conveying paper 2 from the conveying roller 5, and an image forming section 7 is provided at a position downstream from it. The image forming section 7 is a device for transferring toner image onto the paper 2 according to memorized data, and a fixer 8 is provided at a position downstream from the image forming section 7. Further, a pair of conveying rollers 9 are provided at a position downstream from the fixer 8, and an interchanging blade 10 is provided at a position downstream from it.

The interchanging blade 10 is a section for interchanging the direction of conveying the paper 2. For this purpose, it is able to rotate around an axis 10*a*, and it declines to choose between the route to an outlet portion 11 and the route for inverting the paper 2. On the route to the outlet, conveying rollers 12, 13 are provided between the interchanging blade 10 and the outlet portion (stacker) 11. And, a pair of reversible rollers 14 is provided at a position downward from the interchanging blade 10 as shown in the drawing. Behind the sheet feeding cassette 3, downward from the pair of reversible rollers 14, a shunting route A15 is formed, and beneath the sheet feeding cassette 3, a shunting route B16 is formed.

These shunting routes A15 and B16 are combined to comprise a duplex printing unit 15. This is a section for inserting the paper 2 to invert it. On the left side of the reversible rollers 14 as shown in the drawing a pair of conveying rollers 19 and another pair of conveying rollers 20, which rotate respectively to convey paper inverted by duplex printing unit 15, are provided, and in this structure of printer apparatus a sheet feeding sensor 22-1 in the vicinity of sheet feeding roller 4, a shunting route sensor 23 in the vicinity of inlet of duplex printing unit 15, a recording sensor 24 in the vicinity of image forming section 7, and an outlet sensor 25 in the vicinity of the entrance of the outlet portion 11 are provided respectively.

As described above, the printer apparatus 1 shown in FIG. 2 has an internal structure for conveying paper 2, in order to perform duplex printing, and how the paper 2 is conveyed in the printer apparatus 1 will be described next. Here, as an example, the process of duplex printing of a series of four papers (1, 2, 3, 4), each of which has front face (designated F) and back face (designated B), is described. In the usual case, these are printed in the order of 1B, 2B, 1F, 3B, 2F, 4B, 3F, 4F.

As an example, the situation in the printer at the moment when the first paper completes the duplex printing and is issued at the outlet portion (stacker) 11, is shown in FIG. 2. There, the other three papers are positioned at each of the positions on the conveying route in the printer apparatus 1 shown with the thick lines. Here, the naked letters such as 1B, 1F etc. express the state of completion of each printing. On the other hand, the letters put in p parentheses such as (3B), (3F) etc. express the state of uncompleted printing.

That is, the state shown in FIG. 2 is the state of completion of 1B, 2B, 1F in the order of printing. So, at this stage, the first paper with 1F, 1B completed duplex printing has already been issued at the outlet portion 11 as mentioned above. And, at the same stage, the second paper (2F), 2B completed printing only about its back face, is inserted in the duplex printing unit 15. Further, at the same stage, the third paper (3F), (3B), which is going to be printed at the next stage, is coming up to the image forming section 7. But, the fourth paper is still in the sheet feeding cassette 3.

As described above, the schematic structure and brief operation of printer apparatus applied with the present invention, have been introduced. So, the processes comprising the present invention will now be described, going back to FIG. 1.

A Process of Monitoring Existence of Issuable Media

At the moment, when a sheet feeding jam has occurred, this process is performed to watch the continued printing process until a face of the paper in the course of printing is completed, in the case where a paper in the course of printing exists in the printer apparatus 1 (FIG. 2). Hereafter, a paper in the course of printing is called an issuable medium. Incidentally, a sheet feeding jam is a state where the sheet feeding sensor does not become turned ON when a certain prescribed time has passed after a paper has been fed from the sheet feeding cassette 3. This process corresponds to the step S(1)1 of the flow-chart in FIG. 2. This monitoring process is continued while an issuable medium exists in the printer apparatus 1 until the printing process on the issuable medium is completed. When completion of the printing process on the issuable medium is detected by this step, the control proceeds to the next step. On the other hand, in the case where no issuable medium exists in the printer apparatus at the moment when the paper jam occurred, the control starts directly from the next step S(1)2. However, control of this case is not shown in the drawing. In either case, no new medium is provided, because a medium jam has occurred. The state of this case will be described referring to the other drawings.

Figure 3:
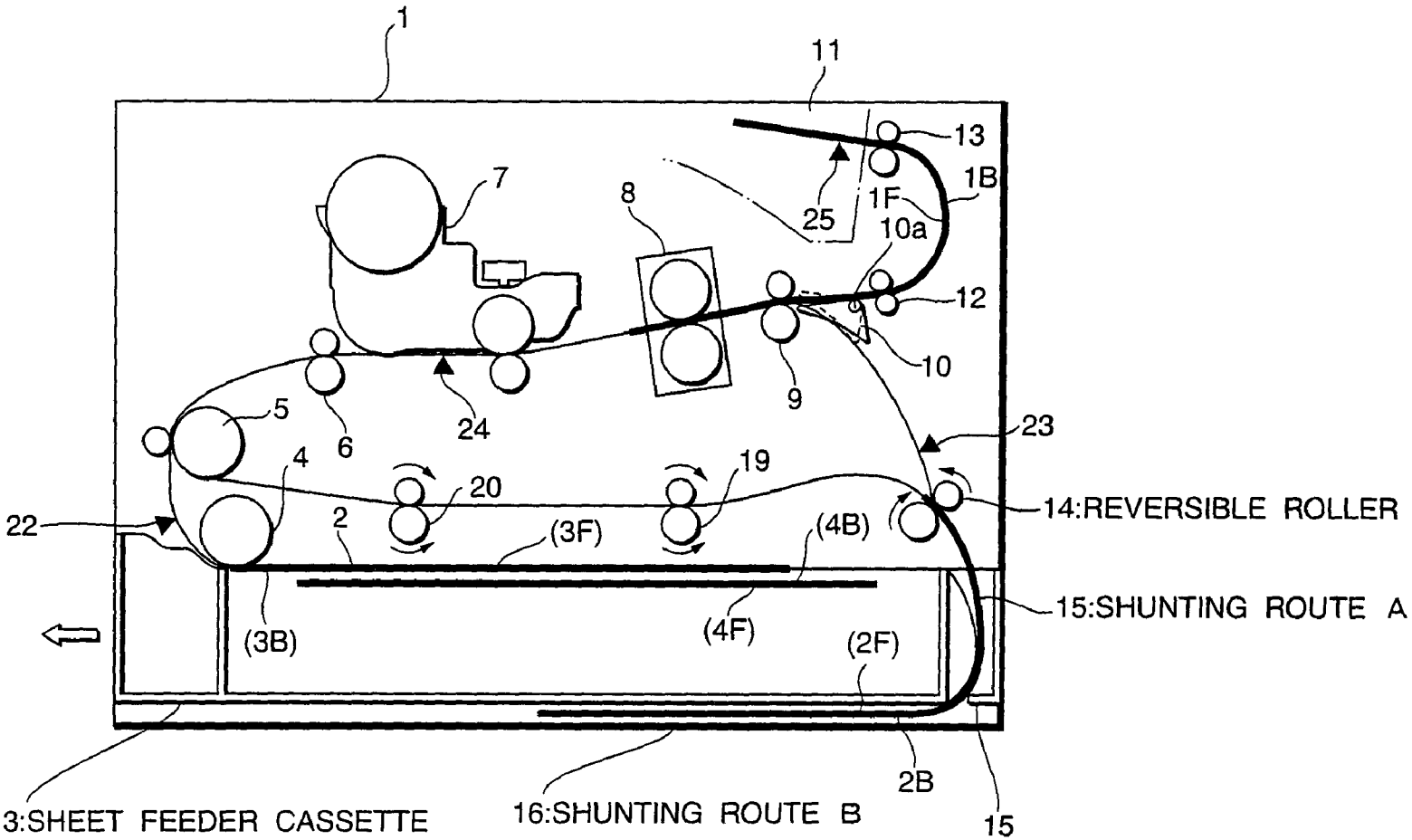
FIG. 3 shows a state of conveying sheets relating to Embodiment 1.

FIG. 3 shows the state of conveying papers according to Embodiment 1.

In FIG. 3, the first paper 1F, 1B is already printed on both it's faces, though its end is still being fixed by fixer 8, and it is not issued yet. However, it is coming out through the outlet opening. On the other hand, the third paper (3F) (3B), which is not printed on either of it's two faces, is in a state of sheet jamming. Moreover, the second paper (2F), 2B is completely inserted or almost completely inserted in the duplex printing unit 15.

A Process of Requesting Relief of a Jam in the Sheet Feeder

This is a process performed when the operator is requested to relieve a jam in a sheet feeder, by presenting the occurrence of the sheet feeding jam at an operator's panel etc. This process corresponds to the step S(1)2 in the flow-chart. The operator is requested to relieve the sheet feeding jam, after the issuable medium is completely issued at the outlet portion 11 and/or another issuable medium is completely inserted in the duplex printing unit 15. So, in the state shown in FIG. 3, the operator is not yet asked to relieve the jam. The request to relieve the jam is presented at an operator panel, after the first paper 1F, 1IB (printing completed on both faces) is completely issued and the second paper (2F), 2B is completely inserted in the duplex printing unit 15. The latter is achieved in FIG. 3. The former will soon be achieved in FIG. 3. This is detected by the outlet sensor 25.

A Process of Confirming Relief of a Jam in a Sheet Feeder

This is a process of confirming the recovery of sheet feeding. The operator takes care of the sheet feeder cassette 3 etc. to relieve a sheet feeding jam. This corresponds to the step S(1)3 in the flow-chart. This process is continued until sheet feeding is detected by the feeding sensor 22, and if it is detected, then, the control proceeds to the next step.

A Process of Monitorng in the Duplex Printing Unit

This is a process of monitoring the removal of sheet feeder cassette 3. This corresponds to the step S(1)4 in flow-chart. And, this monitoring is performed by the shunting route sensor 23 etc. The reason why this monitoring is performed is that the printer apparatus cannot maintain the normal state for proceeding to printing on another face of the paper, in the case where the sheet feeder cassette 3 is removed by the operator after a sheet feeding jam occurred until it is relieved. For example, in the case that the front end of second paper (2F), 2B is coming off the reversible roller 14, the second paper is not able to go for printing on another face. So, the sheet feeder cassette must stay in the printer apparatus 1 in order to keep the issuable paper pinched by the reversible roller 14. This is the same state as the state where a sheet feeding jam did not occur. If the removal of the sheet feeder cassette or another change in the apparatus occurred, then the control proceeds to the step S(1)7 in the flow-chart. Otherwise, the control proceeds to the step S(1)5 in the flow-chart.

A Process of Monitoring Media Existing in Duplex Printing Unit

This is a process performed to watch whether a paper printed with one of its faces exists in the duplex printing unit 15. This process corresponds to the step S(1)5 in flow-chart, and this process is performed with the shunting route sensor 23. If there is a paper printed on one of its faces in the duplex printing unit 15, then control proceeds to the step S(1)6. Otherwise, it proceeds to the step S(1)7. As for the example shown in FIG. 3, there is the second paper (2F), 2B in the duplex printing unit 15. So, the control proceeds to the step S(1)6.

A Process of Re-Using a Double-Faced Medium Completely Printed on One of its Faces.

This is a process performed to re-use the second paper (2F), 2B existing in the duplex printing unit 15, because it is judged to be re-usable. This process corresponds to the step S(1)6 in flow-chart. In the case of FIG. 3, the printing process in the order of FIG. 8(*a*) is re-started from the back face of paper 3B as shown in FIG. 8(*b*). In this case, the second paper (2F), 2B, which is judged to be re-usable; is printed next to the third paper (8F),(3B). Then, it is issued at the outlet portion 11. However, in this case, it is possible to adopt another order of printing. That is, as shown in FIG. 8(*c*), the printing process is re-started from the front face of paper 2F in advance of the third paper (3F),(3B). Then, the third paper (8F),(3B) is printed next to the re-used paper (2F), 2B. That is, the third paper (3F),(3B) in FIG. 8(*c*) becomes the first paper (1F),(1B) in FIG. 8(*a*).

A Process of Removing Media from the Apparatus

This is a process performed when the second paper is not re-usable. In this case, the second paper is removed by the operator, and the face already printed is printed once more on a new second paper, which is newly fed from the sheet feeder cassette 3. This process corresponds to the step S(1)7 in flow-chart. As for the case of FIG. 3, the second paper (2F), 2B; which is judged to be un-re-usable and is removed by the operator, and the printing process is newly re-started from the second paper as shown in FIG. 8(*d*).

The operation mentioned above, is performed by a control section of the printer apparatus 1 not shown in the drawings. Incidentally, all these processes are described as a printing method which comprises an independent program structure. However, the present invention is not limited to this embodiment. That is, the program of this printing method can be included in the control program of a printer apparatus as a part of it, and this printing method can be performed with another kind of control as an overall control of the printer apparatus.

<Effect of Embodiment 1>

As mentioned above, the duplex printing unit is monitored continuously even if a sheet feeding jam has occurred, and a printing medium completely printed on one of its faces can be detected there. This medium is kept in the state, which is the same as the state kept when the sheet feeding jam had not occurred. This medium is re-used at re-starting of printing after a jam. Therefore, it would become possible to avoid issuing of useless printing media in the event that a sheet feeding jam had occurred.

Embodiment 2

Embodiment 2 relates to a printing method in the case where the media conveying route from the duplex printing unit 15 is secured at the moment when a sheet feeding jam has occurred. And, at the some time, a medium completely printed on one of its faces exists in the duplex printing unit 15. Here, the state that the media conveying route is secured, means the state where obstruction to media passing such as jammed sheets etc. does not exist in the conveying route of media.

Figure 4:
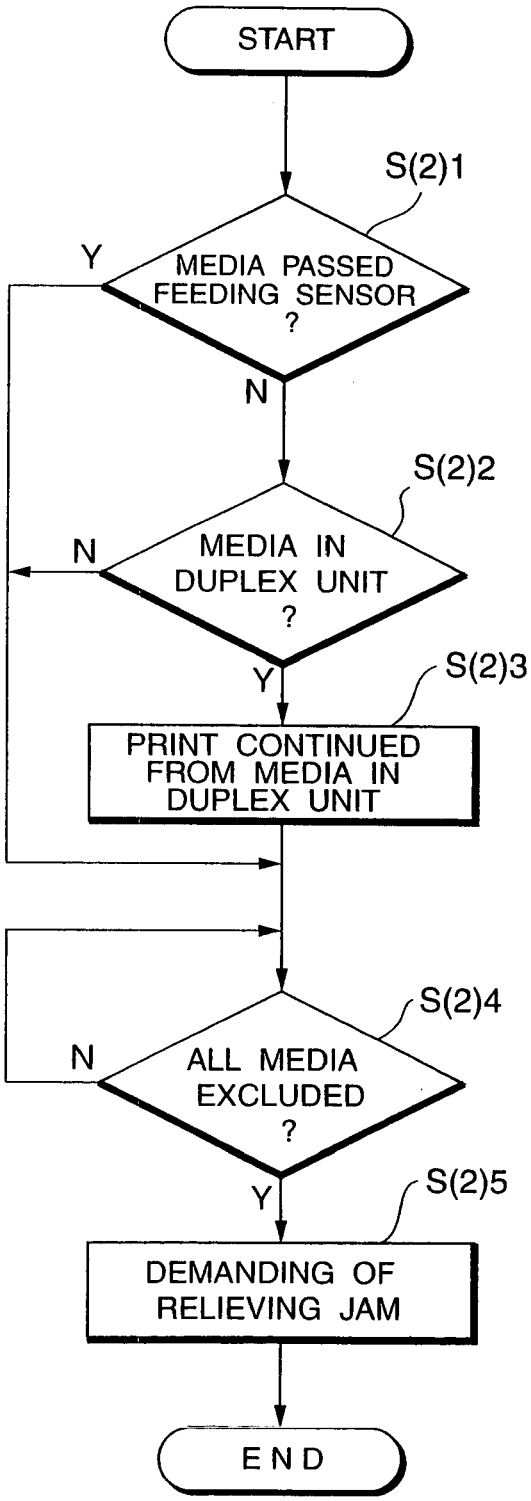
FIG. 4 is a flow-chart showing the process of the printing method of Embodiment 2.

FIG. 4 is a flow-chart showing the printing method of Embodiment 2.

As shown in FIG. 4, the printing method of printer apparatus according to Embodiment 2 comprises a B sheet feeding jam detecting process, a B monitoring process of media existing in the duplex printing unit, a B re-starting process for sending media from the duplex printing unit, a B monitoring process for sending media from the duplex printing unit, and a B process of requesting relief of a jam in the sheet feeder.

Figure 5:
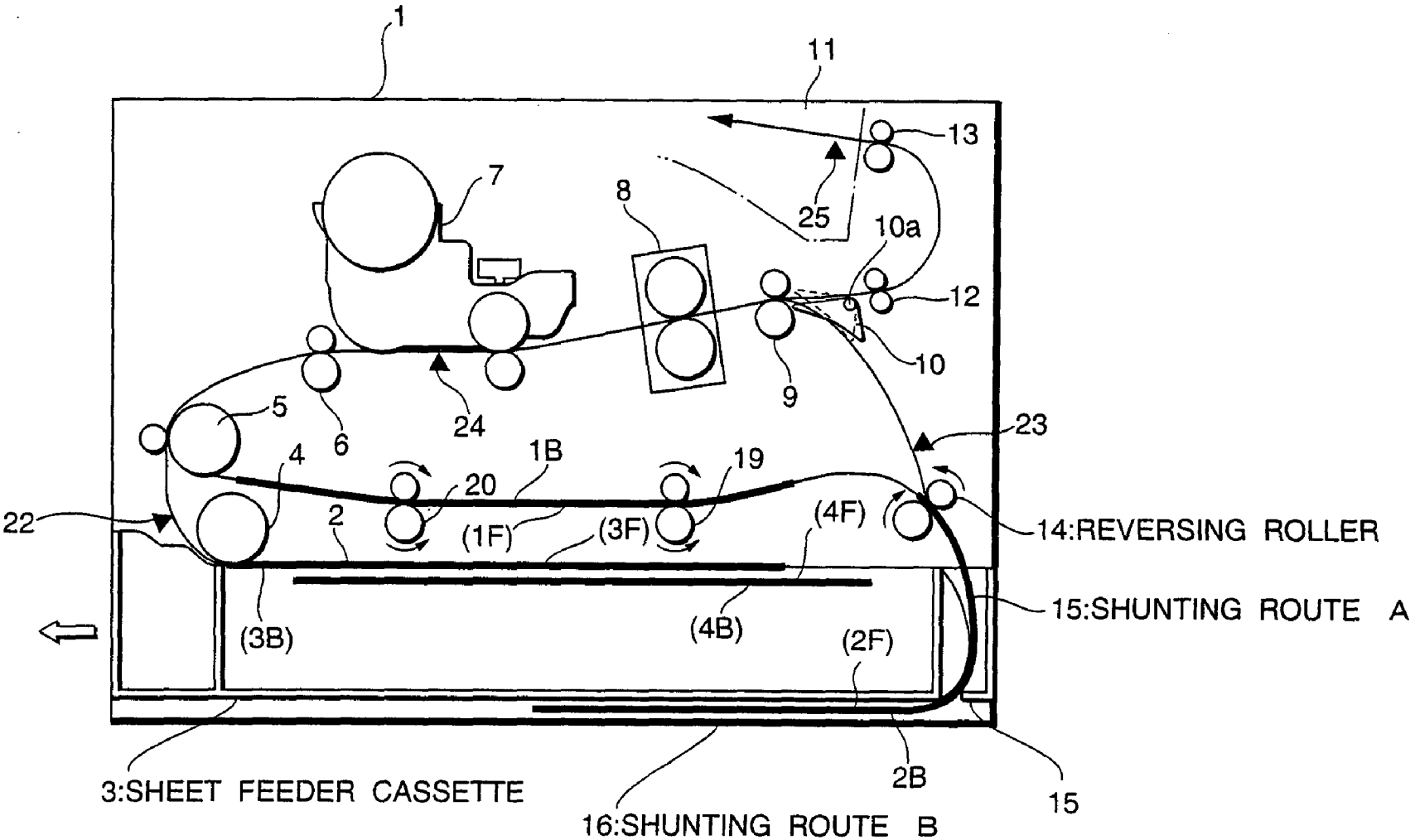
FIG. 5 shows a state of conveying sheets relating to Embodiment 2.

FIG. 5 shows the state of conveying medium relating to Embodiment 2.

In FIG. 5, the first medium (1F), 1B is staying at the position where a pair of conveying rollers 19 and another pair of conveying rollers 20 are provided. And, the second medium (2F), 2B is staying in the duplex printing unit 15. In this state, the third medium is causing a jam of feeding.

B Detecting Process for a Jam in a Sheet Feeder

This is a process of continuous monitoring of a sheet feeder causing a jam. The sheet feeding sensor 22-1 or 22-2 continuously watches the conveying route. A jam in the sheet feeder is detected when a certain prescribed time has past before a medium arrives at the sheet feeding sensor 22-1 or 22-2 after the medium started from the sheet feeder. This process corresponds to the step S(2) 1 in flow-chart.

B Monitoring Process of Media Existing in the Duplex Printing Unit

This is a process performed to monitor the duplex printing unit 15 in order to judge whether a medium completely printed on one of its faces exists there or not. This corresponds to the step S(2)2 in the flow-chart. This judgement is performed with the shunting route sensor 23. If there is a medium completely printed on one of it's faces in the duplex printing unit, then control proceeds to step S(2)3 in the flow-chart. Otherwise, control jumps to step S(2)4 in the flow-chart. As for the example shown in FIG. 5, it proceeds to step S(2)3 because the first medium (1F), 1B is staying at the position where pairs of conveying rollers 19, 20 exist, and the second medium (2F), 2B is staying in the duplex printing unit 15.

B Starting Process of Feeding Media from the Duplex Printing Unit

Figure 9A:
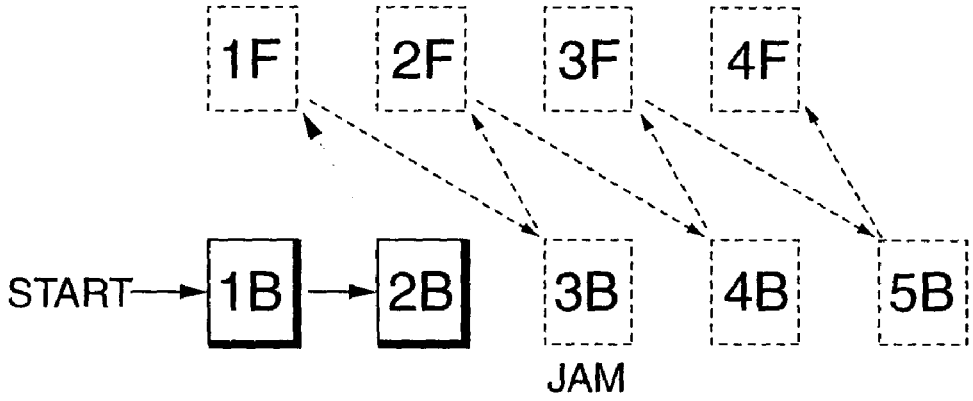
FIG. 9 shows the printing order of Embodiment 2.
Figure 9B:
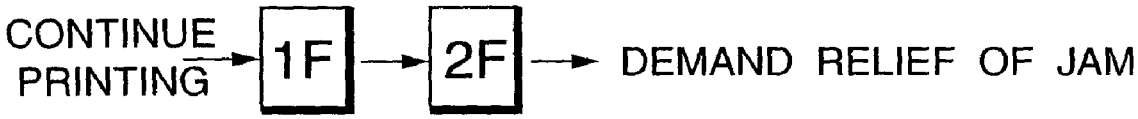
Figure 9C:
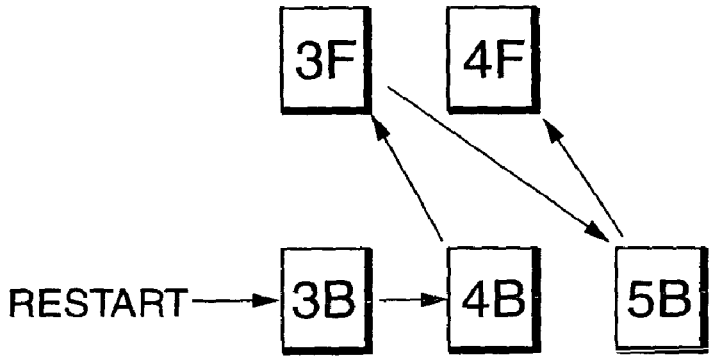

This is a process performed to feed media from the duplex printing unit. This process corresponds to step S(2)3 in the flow-chart. In the case of FIG. 5, as shown in FIG. 9(*a*), the first medium (1F), 1B and the second medium (2F), 2B are completely printed on each one of their faces until a jam occurs. Therefore, as shown in FIG. 9(*b*), at this step S(2)3, they are continued to be printed on each of their opposite (front) faces. The completion of this printing process is confirmed by the recording sensor 24 etc. Then, control proceeds to the next step S(2)4.

B Monitoring Process of Feeding Media from the Duplex Printing Unit

This is a process performed to continue monitoring media fed from the duplex printing unit until they are all issued. This process corresponds to step S(2)4 in the flow-chart, and the issuing of all media is confirmed by the outlet sensor 25 together with the recording sensor 24. Then, control proceeds to the next step S(2)5.

B Process Requesting Relief of a Jam in a Sheet Feeder

This is a process performed to make the operator relieve a jam in a sheet feeder, by presenting information of the occurrence of the jam in the sheet feeder at the operator's panel etc. This process corresponds to step S(2)5 in the flow-chart. This step S(2)5 is processed only after the media completely printed on each one of their faces are printed on the other faces and are issued at the outlet portion 11, and it is not until these media are issued that the fact that the jam in the sheet feeder has occurred is informed to the operator via the operator's panel etc. so as to make the operator relieve the jam. As for the state shown in FIG. 5, the first medium (1F), 1B and the second medium (2F), 2B are going to complete duplex printings to become media 1F, 1B and 2F, 2B issued at the outlet portion 11. After all these steps, relief of the sheet feeder jam is requested. And, after the operator has relieved the jam, the printing process is re-started from the third medium newly fed from sheet feeder cassette 8 in the order shown in FIG. 9(*c*).

The operation mentioned above is performed by a control section of the printer apparatus not shown in the drawings, as in Embodiment 1. Incidentally, all these processes are described as comprising a single printing method. However, the present invention is not limited to this embodiment. That is, all these processes can be included in an overall control program of the printer apparatus as a part of it, so as to perform an overall control process including a printing process together with other control processes. This is the same as in Embodiment 1.

<Effect of Embodiment 2>

As described above, according to Embodiment 2, the following effects are obtained, because sheet feeder jam relief is requested only after duplex printing has been completed and the printed media issued in the case where a conveying route for media from the duplex printing unit is secured and a medium completely printed with only one of its faces exists in the duplex printing unit.

(1) There is no need to abandon media in the duplex printing unit, when one face has been completely printed.

(2) There is no need for operators to printed the other face manually make after relief of a jam.

Embodiment 3

Embodiment 3 relates to a method of continuing printing by changing a sheet feeder cassette in the case where a route for conveying media from the sheet feeder cassette other than that which is now feeding media is secured, and both the size and the position of media are same at the moment when a jam occurred. Here, the state that a route for conveying media is secured, means the state that there is no hindrance in the route for conveying media such as a jam in the sheet feeder.

Figure 6:
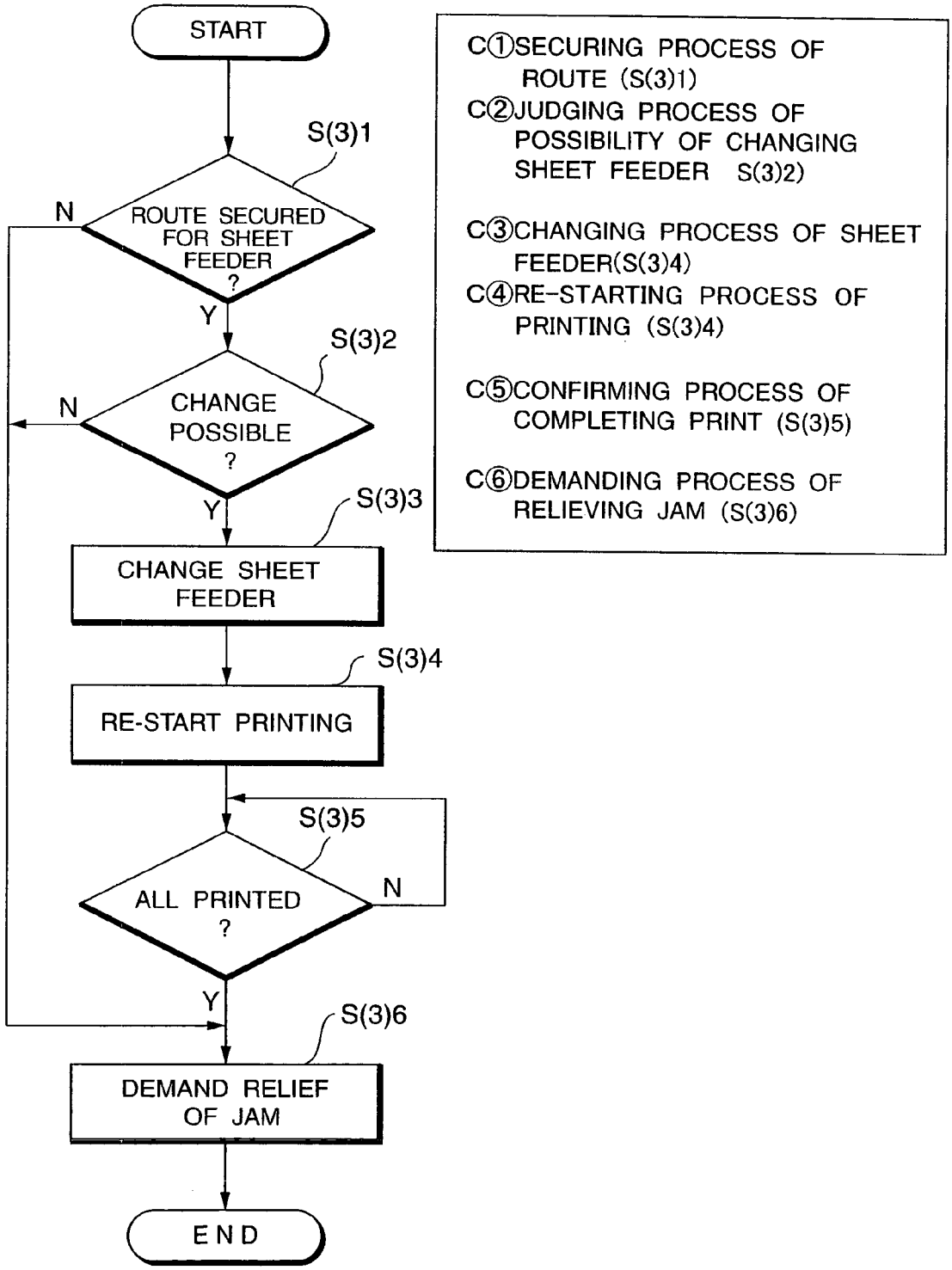
FIG. 6 is a flow-chart showing the process of the printing method of Embodiment 3.

FIG. 6 is a flow-chart showing the printing process according to Embodiment 3.

As shown in FIG. 6, the printing method of Embodiment 3 comprises a C process of securing a route for conveying media, a C process of judging a propriety of changing a sheet feeder cassette, a C process of changing a sheet feeder cassette, a C process of re-starting a printing process, a C process of confirming completion of printing, and a C process of requesting relief of a jam in a sheet feeder.

Figure 7:
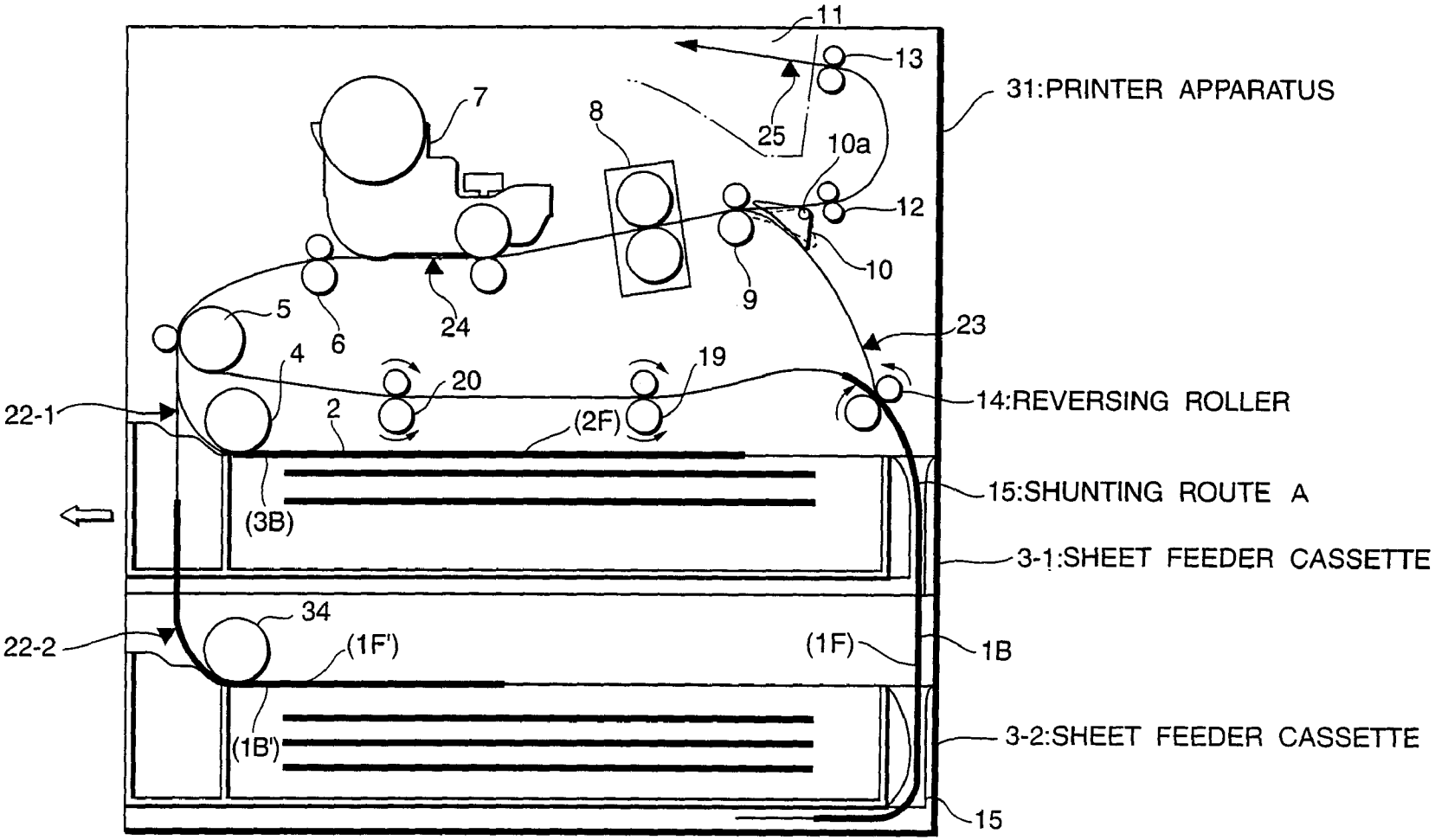
FIG. 7 shows a state of conveying sheets relating to Embodiment 3.
Figure 8A:
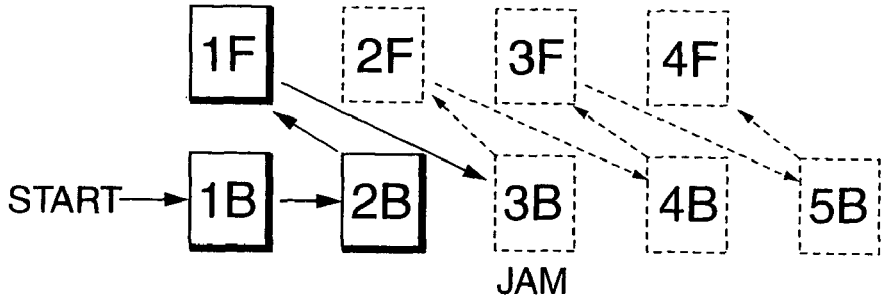
FIG. 8 shows the printing order of Embodiment 1.
Figure 8B:
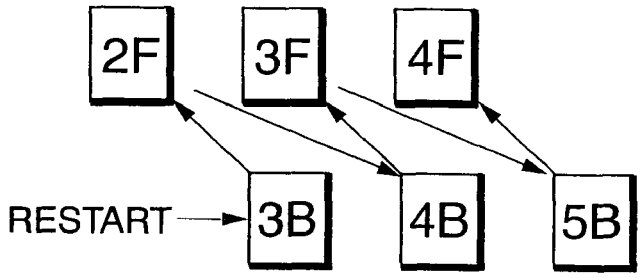
Figure 8C:
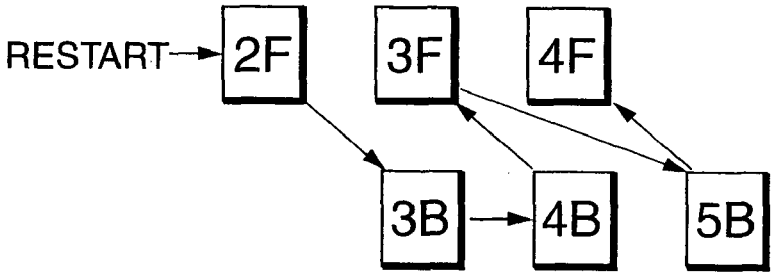
Figure 8D:
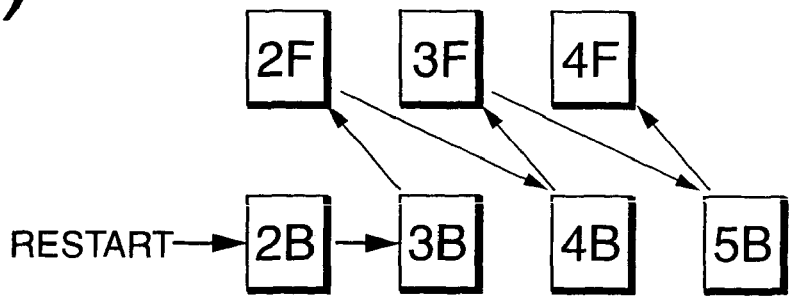

FIG. 7 shows the state of conveying medium according to Embodiment 3.

As shown in FIG. 7, the printer apparatus 31 used in Embodiment 3 has, for example, two sheet feeder cassettes 3-1 and 3-2. The first medium (1F), 1B fed from the sheet feeder cassette 3-1 is inserted in the duplex printing unit 15, and the second medium (2F),(2B) has caused a sheet feed jam at the position of sheet feeding roller 4. Therefore, another first medium (1F),(1B') will be fed from the sheet feeder cassette 3-2 instead of the sheet feeder cassette 3-1. This state is shown in FIG. 7. Hereafter, media fed from the sheet feeder cassette 3-2 are designated by attached prime letters such as the first media (1F'),(1B').

C Process of Securing Route for Conveying Media.

This is a process performed to judge whether there is a sheet feeder cassette connected with a secured route for conveying media. This process corresponds to step S(3)1 in the flow-chart. As shown in FIG. 7, the printer apparatus 31 is attached with another sheet feeder cassette 8-2 different from the sheet feeder cassette 3-1 now feeding media for printing. It is provided that there is no hindrance in the route for conveying media from the sheet feeder cassette 3-2, because the jam of the medium from sheet feeder cassette 3-1 occurred at the position where the sheet feeding roller 4 exists. In this case, the printing control judges that the route for conveying media is secure, and it proceeds to the next step S(3)2. Conversely, in the case when the jam of hte medium has occurred at the position of image forming section 7 etc, the control judges that the route for conveying media is not secure, and it jumps to the step S(3)6 in flow-chart.

C Process of Judging Propriety of Changing Sheet Feeder.

This is a process performed to judge whether the condition of the media, that is the size and position of the media, accord between the sheet feeder cassette 3-1 and the sheet feeder cassette 3-2. This process corresponds to step S(3)2 in the flow-chart. In this case, the size and position of the media in both cassettes plus what is called media type, media unit etc. are compared, and when it is judged that sheet feeder change is impossible, control jumps to step S(3)6 in the flow-chart. On the other hand, when change is possible, control proceeds to the next step s(3)3. This judgement is performed according to data from each kind of sensor such as a sheet size sensor etc. not shown in the drawings.

C Process of Changing Sheet Feeder

This is a process performed to change a sheet feeder now feeding media from it's cassette to a sheet feeder which is able to feed new media. This process corresponds to step S(3)3 in the flow-chart. Here, the sending roller 4 connected with sheet feeder cassette 3-1 has stopped. Instead, the sending roller 34 connected with sheet feeder cassette 3-2 starts rotating. Then, control proceeds to the next step S(3)4.

C Process of Re-Starting Printing

This is a process performed to re-start printing. This process corresponds to step S(3)4 in the flow-chart. Here, the sheet feeder cassette 3-2 feeds new media instead of the sheet feeder cassette 3-1 causing a jam.

C Process of Confirming Completion of Printing

This is a process performed to monitor new media from sheet feeder cassette 3-2. This process corresponds to step S(8)5 in the flow-chart. Here, all the media fed from sheet feeder cassette 8-2 are monitored continuously until they all complete printing and issue at outlet portion 11. These media are watched by a feeding sensor 22-2, the outlet sensor 25 etc. And, when it is judged that all the media have completed printing, control proceeds to the next step S(3)6.

C Process of Requesting the Operator to Relieve a Jam in a Sheet Feeder.

This is a process performed to ask the operator to relieve a jam. This process corresponds to step S(3)6 in the flow-chart, and this is the step performed when all the media fed from the sheet feeder cassette 3-2 have completed printing and issued at the outlet portion 11. Before this step, all the printing processes have completed. Then, relief of jam is requested at this step.

The operation described above is performed by a control section of the printer apparatus 31 not shown in the drawings. Incidentally, in the description mentioned above, that which is provided with two sheet feeder cassettes, is described. However, the present invention is not limited to this embodiment. That is, the number of sheet feeder cassettes can be more than two. In this occasion, it is enough if a conveying route of either of the sheet feeder cassettes other than the one now operating is secure. Moreover, the operation of Embodiment 1 or 2 can be added to the operation of Embodiment 3.

Moreover, in the description mentioned above, the operation of Embodiment 3 is divided into processes. And, each of these processes are described as an independent method of an overall printing process. However, the present invention is not limited to this embodiment. That is, as mentioned in Embodiment 1 and 2, all these processes can be included in an overall control program as a part of it, and, it can be executed step by step including steps corresponding to the processes of Embodiment 3 together with other steps of other kinds of control.

<Effect of Embodiment 3>

As described above, according to Embodiment 3, instead of the sheet feeder cassette that caused the jam, other sheet feeder cassette connected to a secure conveying route and containing same kind of media, are used. Therefore, the following effects are obtained.

(1) The printing process can be continued as long as media are contained in the selected sheet feeder cassette.

(2) Therefore, the labor of the operator can be improved, because the operator is able to deal with relief of jams after a series of printing jobs now executing are completed.

What is claimed is:

1. An image forming apparatus, comprising:

a first conveying section for conveying media, a first conveying section sensor for detecting the media being conveyed by said first conveying section, a second conveying section for reversing the media and for conveying the reversed media, and an image forming section for forming an image on a medium conveyed from said first conveying section or from said second conveying section, wherein, in case that said first conveying section conveys a second medium after conveying a first medium, said second conveying section conveys in said first medium from said image forming section and keeps said first medium, said first medium having completed forming an image, when a jam of said second medium is detected by said first conveying section sensor, said first conveying section conveys a third medium after detecting relief of the jam of said second medium with said first conveying section sensor, and said second conveying section conveys the kept first medium to follow said third medium.

2. An image forming apparatus according to the claim 1 wherein said image forming section forms an image, which should have been formed on said second medium, on a first face of said third medium, and succeedingly forms a succeeding image on a second face of said first medium.

3. An image forming apparatus according to the claim 1, further comprising:

a second conveying section sensor for detecting the media being conveyed by said second conveying section, wherein a demand for a relief of the jam is put out when said second conveying section sensor has detected a change of the state of said second conveying section during a time interval between a time of catching said first medium in said second conveying section and a time of detecting the relief of the jam of said second medium with said first conveying section sensor.

4. An image forming apparatus according to the claim 3, wherein a forming of an image on a second face of said first medium is allowed when said second conveying section sensor has not detected the change of the state of said second conveying section during the time interval between the time of catching said first medium in said second conveying section and the time of detecting the relief of the jam of said second medium with said first conveying section sensor.

5. An image forming apparatus, comprising:

a first conveying section for conveying media, a first conveying section sensor for detecting the media being conveyed by said first conveying section, a second conveying section for reversing the media and for conveying the reversed media, an image forming section for forming an image on a medium conveyed from said first conveying section or from said second conveying section, and a second conveying section sensor for detecting a state of said second conveying section, wherein, in case that said first conveying section conveys a second medium after conveying a first medium, said second conveying section conveys in said first medium from said image forming section and keeps said first medium, said first medium having completed forming an image, when a jam of said second medium is detected by said first conveying section sensor, and said second conveying section conveys the kept first medium, when said second conveying section sensor has not detected a change of the state of said second conveying section during a time interval between a time of catching said first medium in said second conveying section and a time of detecting a relief of the jam of said second medium with said first conveying section sensor.

* * * * *